US006107613A

United States Patent [19]

Welch et al.

[11] Patent Number: 6,107,613

[45] Date of Patent: Aug. 22, 2000

[54] SELECTIVELY SIZABLE CHANNEL COIL

[75] Inventors: George P. Welch; Michael R. Faber, both of Warren, Ohio

[73] Assignee: Ajax Magnethermic Corporation, Warren, Ohio

[21] Appl. No.: 09/274,253

[22] Filed: Mar. 22, 1999

[51] Int. Cl.[7] ..... H05B 6/36

[52] U.S. Cl. ..... 219/672; 219/646; 219/643

[58] Field of Search ..... 219/672, 673–677, 219/646, 652, 654

[56] References Cited

U.S. PATENT DOCUMENTS 5,055,647 10/1991 Heyes et al. ..... 219/645

5,872,352 2/1999 Suganuma et al. ..... 219/646

*Primary Examiner*—Teresa Walberg

*Assistant Examiner*—Jeffrey Pwu

*Attorney, Agent, or Firm*—Fay, Sharpe, Fagan, Minnich & McKee, LLP

[57] ABSTRACT

An adjustably dimensionable inductive heating apparatus includes inductor turns which are supported by a slide or actuator to allow selective positioning of the inductor turns to a variety of positions. The adjustable support members are disposed to allow the inductor turns to move in a relative width dimension or a relative turn spacing or height dimension. Flexible crossover connector cables accommodate turn repositioning without inhibition of inductor movement. Another feature includes selective length adjustment with the inclusion of a plurality of flexible crossover connectors including in-line switches for selecting which crossover connector cable will determine overall coil length.

12 Claims, 5 Drawing Sheets

SELECTIVELY SIZABLE CHANNEL COIL

BACKGROUND OF THE INVENTION

This application relates to induction heating and particularly to inductive heating of workpieces disposed between inductor turns forming a channel. The invention is more particularly applicable to systems wherein the workpiece is moved by a conveyor through the channel formed by the coil for heating. However, it will be appreciated to those skilled in the art that the invention could be readily adapted for use in other environments as, for example, where similar conductors employed for induction heating can be selectively adjusted and positioned to improve the quality of the inductive heating process of the workpiece.

Conventional induction heating systems have lacked the ability to be conveniently adjustable so that the inductor turns can accommodate a wide variety of different configurations and sizes of workpieces. Typically, a conveyor and workpiece member would be employed to convey the workpiece through a fixed induction heating coil for heating to a desired temperature. In such assemblies, the construction of the coil itself is completely fixed and thereby limited to a part size so that when different parts are sought to be heated by the coil, the coil would have to be disassembled, and reassembled in a different size for more efficient heating of the workpiece.

With particular reference to FIGS. 1A and 1B, a conventional fixed channel coil is shown. The coil 8 is comprised of inductor turns 10, 12, 14, 16 supported by frame members 18, 20. Power is supplied to the turns 12 and 16 via connectors 24, 26 at first end 32 and the circuit is closed at the other end 30 by crossover connectors 34 and 36. Crossover 38 on end 32 connects turns 10 and 14. Of special significance in this structural assembly is that the conductor turns are all supported and attached to fixed frame and connector members. In particular, crossover connectors 34, 36 and 38 comprise rigid structural connections to preclude adjustment of the relative spacing between the turns 10–16 so that after the assembly 8 is constructed, the dimensions of the channel are fixed relative to the length, width and height spacing between the turns. Accordingly, the coil is constructed to accommodate and process a generally single sized workpiece. If the size of the workpiece were to change so that existing coil dimensions are either unacceptable or undesirable, the entire coil must be disassembled and reassembled with connectors of different dimensions to better accommodate the new sized workpiece. Alternatively, a plurality of coils of different dimensions would be serially aligned and only the coil that would best perform the heating job would be operable, but the costs of such an assembly, as well as its overall inefficiency, make such a system highly undesirable.

The subject invention comprises a new and improved adjustable coil assembly that can accommodate quick and easy independent adjustment of coil dimensions such as width and turn spacing to more efficiently meet varying part dimensions or process requirements within a given heating system.

SUMMARY OF THE INVENTION

In accordance with the present invention there is provided a dimensionally adjustable heating assembly for inductive heating of a workpiece including at least first and second inductor turns disposed to comprise an inductive coil. The turns are connected by a flexible connector thereby permitting independent relative adjustment of the positions of the turns so that the dimensions between the turns can vary. The turns are supported by a position adjuster such as a linear actuator which is fixed to the inductor turns for selectively moving the inductors from a first position to a second position for improved heating of the workpiece. Although, certainly a manual adjustment system is also possible.

In accordance with another aspect of the present invention, all of the inductor turns are independently supported by a position adjuster so that each turn can independently move to a preselected position.

In accordance with another aspect of the present invention, each inductor turn is also supported by a second position adjuster for selectively moving the turns in a different direction from that of the first position adjuster. More particularly, if the first position adjuster is intended to adjust the width spacing between inductor turns, the second position adjuster can operate in an essentially vertical dimension for selectively adjusting the relative height spacing between the turns.

In accordance with yet another aspect of the present invention, a plurality of flexible crossover connectors are associated with the turns wherein the connectors include in-line switches for selectively opening or closing the connector for effectively adjusting the length of the coil.

The invention is applicable to an adjustable channel coil for heating workpieces of varying dimensions. The relative spacings both in height and width between a plurality of inductor turns is adjusted by position adjusters which can selectively translate the relative height and width spacing of the turns. Flexible straps or connectors communicate power to the inductor turns while the flexible nature of the straps permits the position adjustment of the turns.

In one particular aspect of the invention, the turns also include in-line switches for effectively selecting which of the straps can function as the crossover connection whereby the selection of such switch straps effectively provides the overall length of the channel coil.

An important benefit of the subject invention is quick and easy independent adjustment of width, height and length spacing to more efficiently accommodate varying part dimensions and thereby avoid disassembly and reassembly of the coils with fixed dimension crossover connectors and power supply connections.

Another benefit of the present invention is length adjustment of the coil without having to reposition any of the inductor turns by the controlled switching on or off of a particular crossover connector.

Other benefits and advantages of the subject invention will become apparent to those skilled in the art upon a reading and understanding of this specification.

BRIEF DESCRIPTION OF THE DRAWINGS

The invention may take physical form in certain parts and arrangements of parts, the preferred embodiments of which will be described in detail in the specification and illustrated in the accompanying drawings which form a part hereof and wherein.

DETAILED DESCRIPTION OF THE INVENTION

Figure 2:
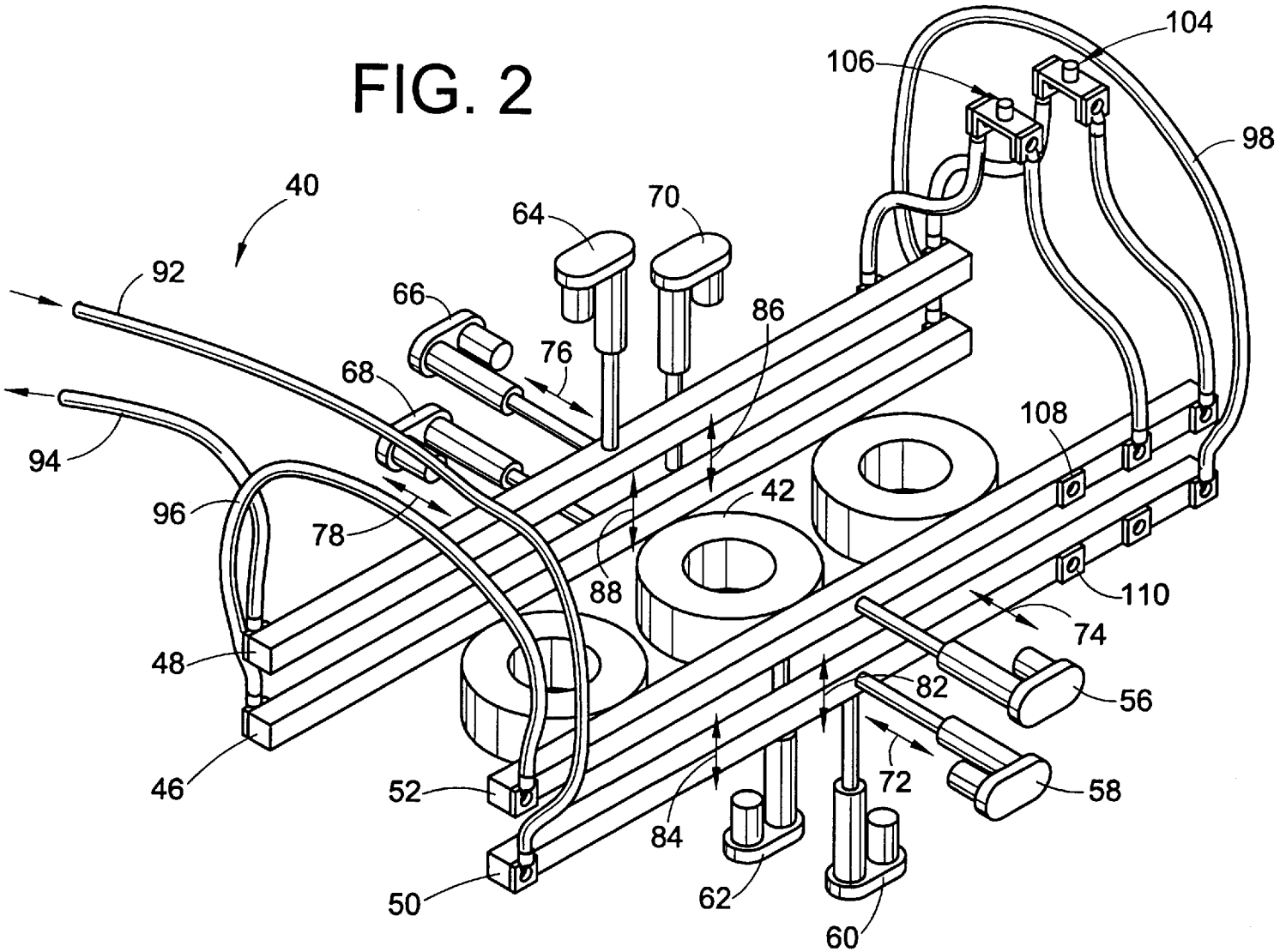
FIG. 2 is a schematic perspective view of an adjustable channel coil formed in accordance with the present invention.

Referring now to the drawings wherein the showings are for purposes of illustrating the preferred embodiments of the invention only and not for purposes of limiting same, FIG. 2 shows an induction heating assembly 40 for heating workpieces 42 typically conveyed through the assembly by a conveyor system (not shown). Ordinary uses of such an assembly include heating for hardening, tempering, annealing, shrink fittings coating, brazing and a forging of the workpieces. Accordingly, the workpiece is heated to the desired process temperature. The most efficient process for such heating will involve a preferred spacing of the inductor turns of the assembly. The subject invention provides for quick and easy independent adjustment of the inductor turns width and height spacings to best accommodate the particular workpieces being heated and thereby avoid the difficulties and inconveniences of disassembly and reassembly of bolted connectors that are fixed in size and must be changed due to a size variance in the workpiece.

Figure 1A:
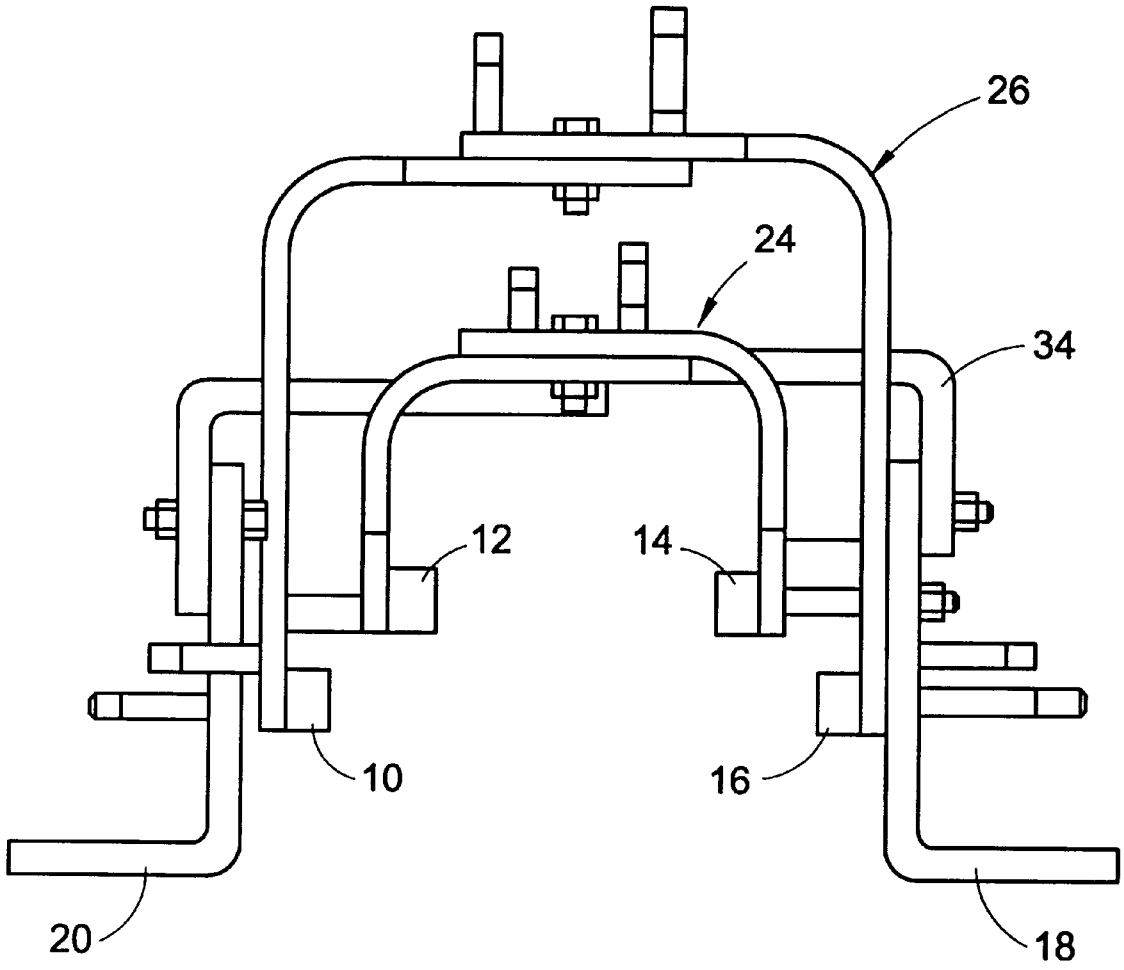
FIG. 1A (PRIOR ART)
FIG. 1A is an end view of a prior art fixed dimension channel coil.
Figure 1B:
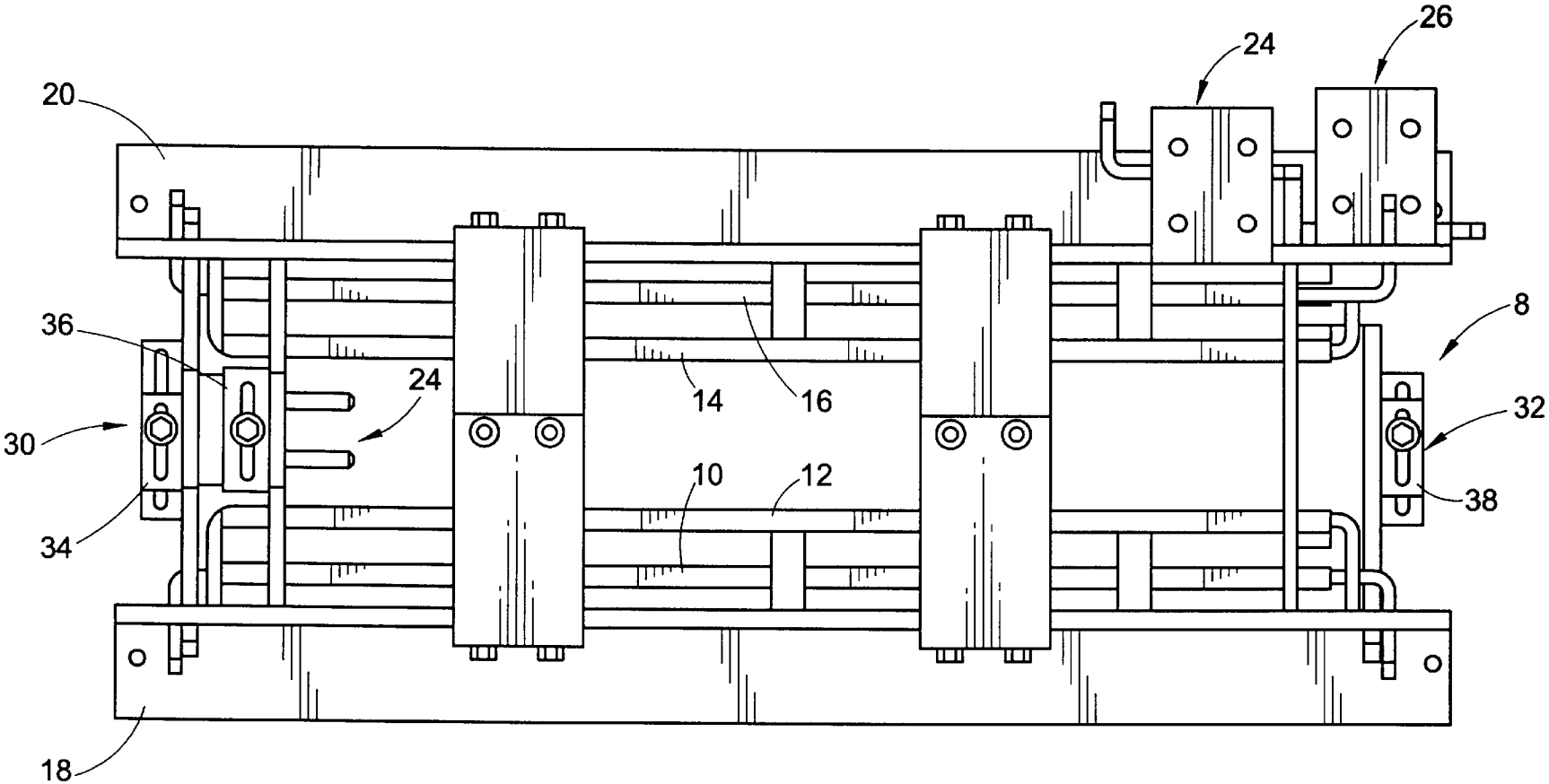
FIG. 1B (PRIOR ART)
FIG. 1B is a top plane view of the coil of FIG. 1A.

More particularly, the inductor turns 46, 48, 50, 52 comprise conventional copper inductor turns similar to the turns shown in FIGS. 1A and 1B, but with the important distinction of not being bolted to a fixed frame for support. It is an important feature of the invention that the inductor turns 46–52 are each supported by actuators 56, 58, 60, 62, 64, 66, 68, 70 which can adjust the position of the inductor turn to which it is attached. Although, as shown, the actuators comprise piston and cylinder assemblies which may be either electrically, hydraulically or pneumatically controlled; however, it is within the scope of the invention to include alternative structural members that can support and position the conductor turns such as chain and sprocket assemblies, hinges or slide beams and the like. Whatever structural support is employed need only reliably and predictably support the turns 46–52 and permit movement to a desired position for the improved heating of the workpiece. Manual adjusters could also be employed.

Another important feature of the invention is that the position adjusters can selectively adjust both the overall width of the channel coil as well as the height of relative turn spacing. More particularly, actuators 56, 58, 66 and 68 are generally aligned in a horizontal dimension relative to the channel through which the workpiece will travel so that the inductor turns may move in a dimension and direction shown by dimensional arrows 72, 74, 76, 78. It should be noted that the lower turns 46, 50 will move in the first plane from a first position to a second position while the upper inductor turns 48, 52 can independently move in a second plane dimension defined by the parallel orientation of the upper inductor turns. Accordingly, such horizontal actuators allow the overall width of the channel to be selectively adjusted so that a preferred width, which best provides operating efficiency and/or temperature profile requirements for the heating processes is achieved. Although in the illustrated embodiment, a multi-turn channel coil is shown, the subject invention is also applicable to a single turn channel coil comprising only a pair of opposed inductor turns.

It is another feature of the invention, that in addition to width spacing, a relative turn spacing, i.e., the relative height spacing between adjacent turns, can also be accurately and predictably controlled. Position actuators 60, 62, 64, 70 are each respectively associated with one of the inductor turns 46–52 and operate in a dimension rotated 90° from the horizontal actuators to selectively space or position the inductor turns in a vertical dimension as shown by dimensional arrows 82, 84, 86 and 88. Although the connection of the pistons of the assemblies 60 and 62 appear to be directly to a bottom wall of the inductor turns 50, 52, the actual nature of the physical connection may be different to allow the conductor turns to be positioned in the same vertical plane. Accordingly, the connection process may involve some spacing of the pistons from the vertical plane of the inductors by an offset or spacing member. Again, for purposes of the subject invention, it is only important that the inductor turns themselves be reliably positioned with regard to the workpiece by whatever structural actuator is employed. In addition, although not shown, the structural support for the actuators must include some support base as a bias for inductor turn movement but the actuators themselves also must be able to move orthogonally relative to the support base to accommodate position adjustment by the second associated actuator for each inductor turn. For example, inductor turn 50 is positioned in a width or horizontal position by actuator 58 and in a height or vertical position by actuator 60. When actuator 58 adjusts the position of the inductor turn 50 in a horizontal planar dimension, actuator 60 must be able to move with the movement of the inductor turn, and vice versa.

Another important structural feature of the subject invention is the adjustable or flexible nature of the straps or cables by which power is communicated to and between the inductor turns. High frequency power from a power supply (not shown) is communicated to the assembly through input power cables 92, 94. Flexible crossover connectors 96, 98 allow the power to be communicated between the respective inductor turns to which the cables are connected. Although flexible cables are shown, some alternative variable connecting devices could be employed such as, slide connectors or the like. Whatever connectors are employed must be able to communicate the power to the inductor turns without impeding their selective positioning and adjustment.

Yet another feature of the invention is shown with regard to switched crossover connector cables 102, 104. The inductor turns 50, 52 are shown as having a plurality of terminal connectors 108, 110 where a bolt connection can be made at a terminal end of one of the connection cables. Where a plurality of such switch connector cables are employed, the switches in the cables can be turned on or off to adjust the effective operative length of the channel coil. For example, if switch cable 102 were opened and switch cable 104 was closed, the channel would have a length dimension defined by the position of cable 104. On the other hand, if switch cable 104 were opened and switch cable 102 were switched closed, then the channel would have a smaller overall length dimension defined by the position of flexible cable 102 Multiple switches could be employed to adjust the length of other turns.

The subject invention provides for inductor adjustment for achieving independent width of each turn and/or turn spacing. Although linear actuators have been shown that can implement preselected recipe positioning or automated positioning, the invention can also be implemented with manual adjustment of the inductor turn positions.

Figure 3:
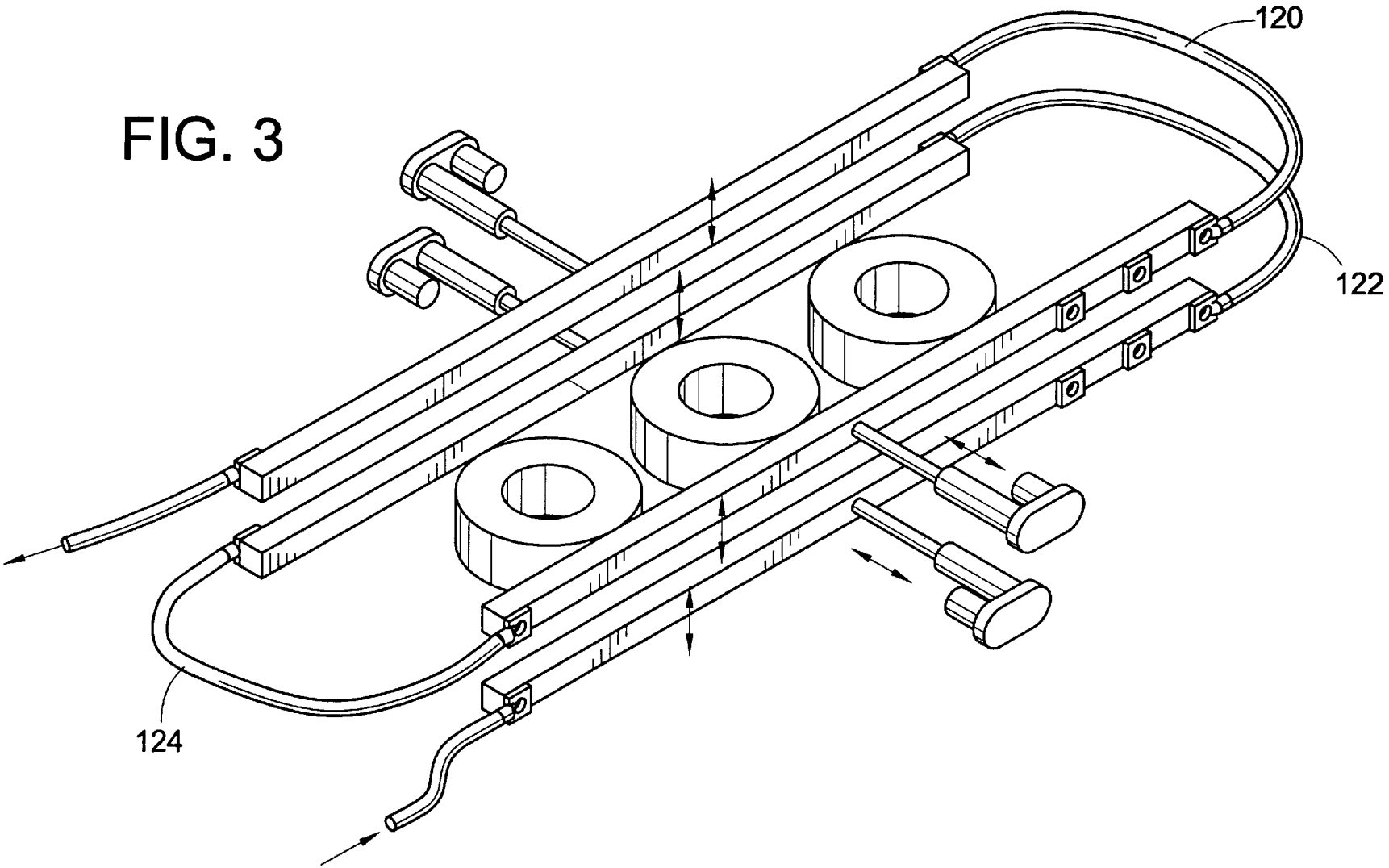
FIG. 3 is a schematic perspective view of an alternative embodiment of the invention comprising a wide oval type coil; and, FIG. 4 is another alternative embodiment comprising a combination of a channel coil at one end and a wide oval coil at the other end.

With particular reference to FIG. 3, the alternative embodiment comprising a wide oval coil is shown in which connector cables 120, 122 are disposed in essentially the same planes as the inductor turns. In this embodiment, the turns are adjusted in position to adjust coil width as in the first embodiment and the nature of the flexible connectors 120, 122, 124 facilitates the movement of the turns to preselected positions.

Figure 4:
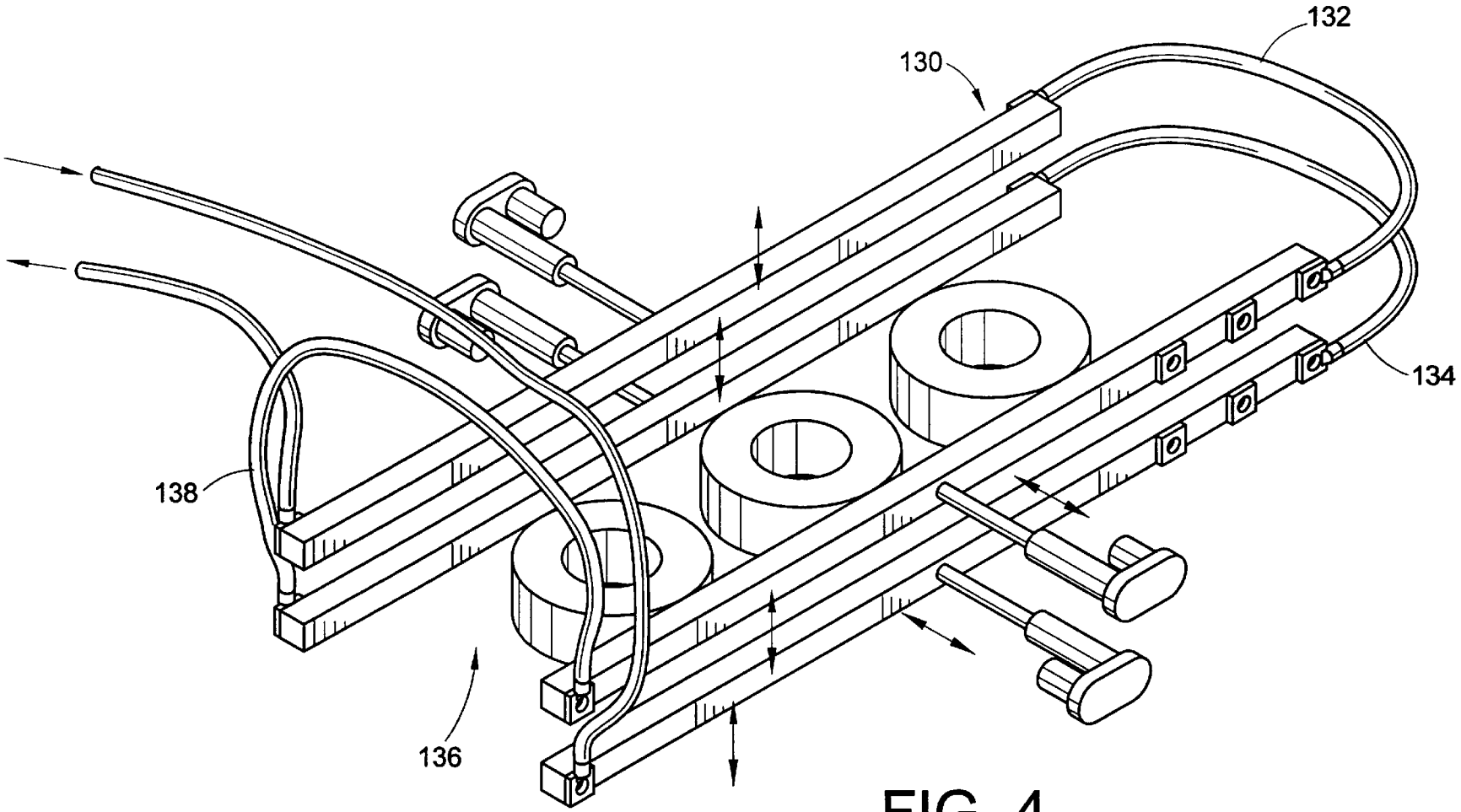

FIG. 4 is another embodiment in which, at one end 130 of the coil assembly, the connectors 132, 134 are co-planar with the inductor turns and at the other end 136 the connector 138 is disposed as a cross-over connector in the manner of the embodiment of FIG. 2. FIG. 4 is thus a combination coil, having one end in a manner similar to FIG. 3 and the other end in a manner similar to FIG. 2, but in both the embodiments in FIGS. 3 and 4 the inductor turns are positionable by linear actuators, as is shown in FIG. 2 (although for purposes of simplicity of illustration, the linear actuators for adjusting the turns in a height or vertical dimension have been deleted.) Whatever adjustment is employed, the subject invention provides an adjustable channel coil that allows a user to maintain good inductor efficiency and/or temperature uniformity with one coil as opposed to the disassembly and reassembly of a coil to a different position, or the implementation of multiple specifically dimensioned coils.

The invention is described with reference to the preferred embodiments. Modifications and alterations will occur to others upon a reading and understanding of the specification. It is the intention of the inventors to include all such modifications and alterations as a part of this invention to the extent they come under scope of the appended claims or the equivalents thereof.

Having thus described the invention, we now claim:

1. An adjustable channel coil for inductive heating of a workpiece comprising:

a plurality of inductor turns each respectively supported by an associated actuator for selective translation of each of the turns in a first dimension;

a second actuator for selective translation of the associated actuator and the inductor turns in a second dimension; and a flexible crossover connector electrically connecting the inductor turns for accommodating independent adjustment of turn width and spacing.

2. The channel coil as defined in claim 1 wherein the crossover connector includes a switch.

3. The channel coil as defined in claim 2 wherein the turn includes a plurality of connector terminals and a plurality of the crossover connectors connecting the turns at the connector terminals, and wherein the plurality of crossover connectors comprise means for selection of an operative length of the channel coil.

4. A dimensionally adjustable heating assembly for induction heating of a workpiece including:

first and second rigid inductor turns disposed to comprise an inductive coil and connected by a flexible connector;

a position adjuster fixed to the first inductor turn for selectively moving the first inductor turn from a first position to a second position in a first plane; and a second position adjuster fixed to the second inductor turn for selectively moving the second inductor turn in the first plane.

5. The heating assembly as defined in claim 4 including a second position adjuster fixed to the second inductor turn for selectively moving the second inductor turn in the first plane.

6. The heating assembly as defined in claim 4 including a third position adjuster fixed to the first inductor turn for selectively moving the first inductor in a second plane.

7. The heating assembly as defined in claim 6 including a third position adjuster fixed to the second inductor turn and operating in tandem with the second position adjuster.

8. An induction heating coil for inductive heating of a workpiece comprising:

a plurality of rigid inductor turns supported by a selectively adjustable support member for selective positioning of the turns; and, a connector for communicating power between the turns, wherein the connector is flexible to preclude inhibiting of the selective positioning of the turns.

9. The heating coil as claimed in claim 8 wherein a plurality of crossover connectors are included and selected ones of the plurality include in-line switches for opening or closing the connector.

10. The heating coil as claimed in claim 8 wherein the connector comprises a crossover connector disposed for the coil to form a channel coil.

11. The heating coil as claimed in claim 8 wherein the connector is disposed for the coil to form a wide oval coil.

12. The heating coil as claimed in claim 8 wherein a plurality of connectors are included and selective ones of the plurality are disposed at a first end of the turns to form a wide oval end of the coil and selective others of the plurality are disposed at an other end of the turns to form a channel end of the coil.

* * * * *